United States Patent [19]

Kemeny

[11] Patent Number: 4,754,687

[45] Date of Patent: Jul. 5, 1988

[54] MULTI-STAGE ELECTROMAGNETIC LAUNCHER WITH SELF-SWITCHED INDUCTIVE POWER SUPPLIES

[75] Inventor: George A. Kemeny, Wilkins Township, Allegheny County, Pa.

[73] Assignee: Westinghouse Electric Corp., Pittsburgh, Pa.

[21] Appl. No.: 934,385

[22] Filed: Nov. 24, 1986

[51] Int. Cl.[4] ..... F41F 1/02

[52] U.S. Cl. ..... 89/8; 124/3; 361/159

[58] Field of Search ..... 60/202; 89/8; 124/3; 318/35, 135; 310/12, 13, 14; 361/159

[56] References Cited

U.S. PATENT DOCUMENTS 4,319,168 3/1982 Kemeny ..... 89/8

4,343,223 8/1982 Hawke et al. ..... 89/8

4,572,964 2/1986 Honig ..... 89/8

*Primary Examiner*—Stephen C. Bentley

*Attorney, Agent, or Firm*—D. Schron

[57] ABSTRACT

An electromagnetic launcher having spaced-apart rails for launching a projectile includes a plurality of stages connected to the rails for supplying makeup current during a projectile launch. Each stage includes an inductive power supply and an electrically conducting loop physically adjacent the rails for a predetermined length and including a conducting switch, such as a controlled rectifier array. As a projectile launching armature enters the loop area, a countercurrent is built up in the loop and at current zero the switch reverts to a non-conducting condition, thereby causing injection of the inductive current into the rails.

12 Claims, 7 Drawing Sheets

MULTI-STAGE ELECTROMAGNETIC LAUNCHER WITH SELF-SWITCHED INDUCTIVE POWER SUPPLIES

BACKGROUND OF THE INVENTION

1. Field of the Invention

The invention in general relates to electromagnetic parallel rail launchers and particularly to a system wherein current is sequentially injected into the rails at spaced-apart locations during projectile acceleration.

2. Description of the Prior Art

An electromagnetic launcher basically consists of a power supply and two generally parallel electrically conducting rails between which is positioned an electrically conducting armature. Current from the power supply flows down one rail, through the armature and back along the other rail whereby a force is exerted on the armature to accelerate it and a payload so as to attain a desired muzzle or exit velocity. Alternatively, current condition across the parallel rails may be by a plasma or arc which creates an accelerating force on the rear of a sabot which in the bore length supports and accelerates the projectile.

In one common type of electromagnetic launcher, the power supply is comprised of a direct current homopolar generator in series with an inductive energy storage device. A firing switch is electrically connected to short the breech end of the electrically conducting rails and is in series with the power supply.

Prior to firing a projectile, the rotor of the homopolar generator is driven to a desired rotational speed at which point, with the firing switch in the closed position, current flow is established through the storage inductor. When the current through the inductor reaches a predetermined firing level, the firing switch is opened to commutate current into the projectile launching rails. In general, for a given current, the muzzle velocity of the projectile is governed by the length of the rails. If a muzzle velocity measurable in tens of kilometers per second is desired, or lower velocities but with heavier projectiles, then the length of the rails required may be hundreds of meters. Such an arrangement would experience undesirably high conducting rail ohmic losses, and therefore low energy efficiency, and the unavoidable current attenuation during projectile acceleration will result in an excessive acceleration deterioration during projectile traverse.

Accordingly, it has been proposed that a shorter rail length for a required muzzle velocity may be obtained by resupplying energy at successive locations along the rails so that close to full acceleration is attained throughout the rail length. This is accomplished by providing individual power supplies electrically connected to the rails at predetermined locations along the bore length to achieve a relatively more constant current and accordingly nearer to the maximum sustainable acceleration with minimum barrel length.

One such multi-stage arrangement utilizes capacitive power supplies to provide the necessary additional current at successive rail locations. Such capacitive power supplies are ideal in that the switch arrangement necessary to electrically connect them to the rails can be triggered to an accuracy measurable in nanoseconds. If the total energy level requirements are high, however, such capacitive power supplies are prohibitively expensive and excessively voluminous.

Another type of proposed multi-stage arrangement utilizes a more compact and less expensive homopolar generator-inductor arrangement previously described. If ultrahigh velocities are required, however, the mechanical switching arrangement utilized to commutate current into the rails cannot operate to the high degree of accuracy needed, nor are mechanical switches able to generate the high commutating voltages required for ultrahigh projectile velocities.

The present invention provides for a multi-stage arrangement utilizing inductive power supplies wherein the arrangement is self-switching so that the additional current is injected into the rails at precisely the right moment.

SUMMARY OF THE INVENTION

An electromagnetic launcher in accordance with the present invention includes one or more additional inductive energy storage stages connected to the rails of the launcher downstream of the breech end. An electrically conducting bore flux linking loop is connected to the rails at the point of current injection by the stage power supply, with the loop including a switch means such as an array of solid state controlled rectifiers. When the propelling current-carrying armature of the launcher enters the loop area a counter current is produced to cause a current zero through the switch means thereby allowing the interruption of current flow in the loop and resulting in injection of the inductive current into the rails.

DESCRIPTION OF THE PREFERRED EMBODIMENT

Figure 1:
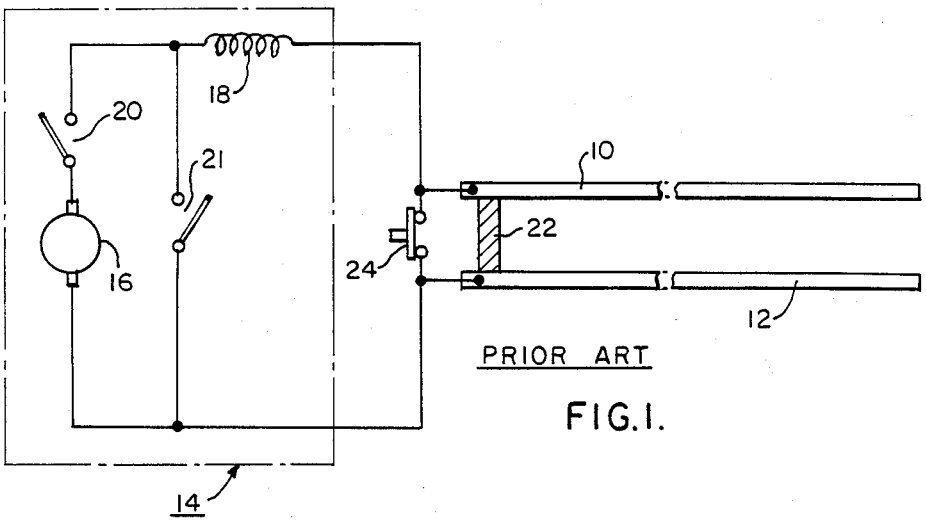
PRIOR ART FIG. 1.
FIG. 1 illustrates a prior art electromagnetic launcher with a homopolar generator-inductor power supply.

A typical electromagnetic launcher, as depicted in FIG. 1, includes electrically conducting, generally parallel rail members 10 and 12 connected to a source of high current 14. One example of such source includes a homopolar generator 16 in series with an inductive energy storage device in the form of inductor 18, the series connection being made upon closure of make switch 20. Switching means 21 in parallel with the homopolar generator 16 represents a crowbar switch which upon actuation provides a bypass for current which normally flows through the homopolar generator.

A movable armature 22 is slidably positioned between the rails for propelling a projectile along the rails when supplied with current. In operation, when the homopolar generator 16 is revved up to a predetermined speed, switch 20, which may be incorporated as part of the brush system of the homopolar generator, is closed, thereby initiating the charging of inductor 18. When a certain firing level is reached, firing switch 24 connected to short out the breech end of the rail members is opened, thereby commutating current into the armature 22. The electric current which enters the rail 10, passes through armature 22, and leaves via rail 12, induces a magnetic field, the interaction of which with the current through the armature gives rise to a force on the armature to accelerate it and its projectile payload. Current magnitudes, depending upon the system, may be in the order of hundreds of thousands of amperes to millions of amperes, and exit velocities measurable in many kilometers per second are attainable.

Figure 2:
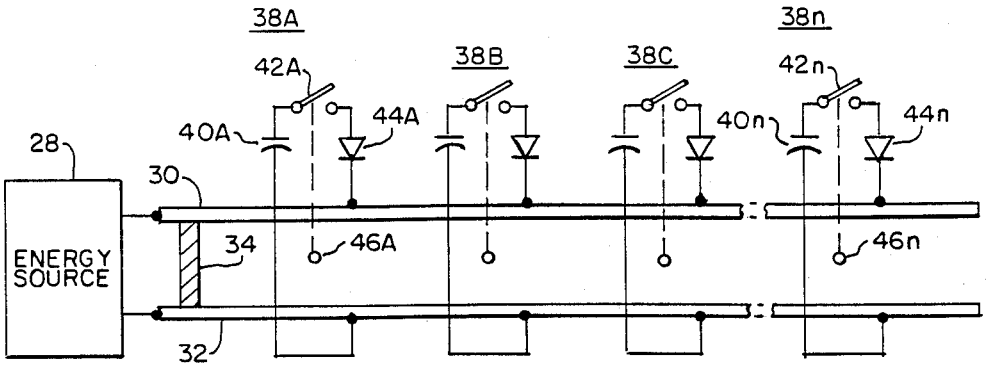
PRIOR ART FIG. 2.
FIG. 2 illustrates a prior art multi-stage system with distributed capacitive power supplies.

If current is injected into the rails from a number of optimally located separate energy storage locations at precise times during the course of travel of the armature (or plasma) and projectile, a relatively constant acceleration force along the entire length of the rails may be achieved. The arrangement reduces the length of the rails required for a desired muzzle velocity, with the reduction in rail current conducting length additionally resulting in lower rail ohmic heating and ohmic heating losses. One such well known multi-stage arrangement is illustrated in FIG. 2.

An energy source 28 is arranged to provide high current to rails 30 and 32 bridged by movable armature 34. A plurality of energy storage stages 38A, 38B, 38C . . . **38*n* are positioned at predetermined locations along the rails for supplying additional or make up current thereto as the armature or plasma passes. Taking steps 38A as exemplary, the stage includes a capacitive energy storage arrangement 40A in series with a switch means 42A and a diode array 44A**.

A sensor 46A is positioned to detect the presence of armature 34 during its course of travel down the rails and is operative to close switch 42A at precisely the right moment so as to deliver a surge of current from the capacitive storage 40A through the diode array 44A, to the rails and through the armature 34. As the armature 34 passes subsequent sensors 46B to **46*n***, the associated stage will be activated for current delivery.

The stage capacitive storage arrangements are ideal in that they can be triggered to deliver current, by activation of switch 42, to an accuracy of nanoseconds. For high velocity launchers, however, the current and energy requirements may be so high as to make the capacitive energy storage supplies excessively voluminous and prohibitively expensive. In such case inductive energy storage arrangements are preferred since they can typically store 100 times as much energy per unit weight as capacitive storage. One such arrangement is illustrated in FIG. 3.

Figure 3:
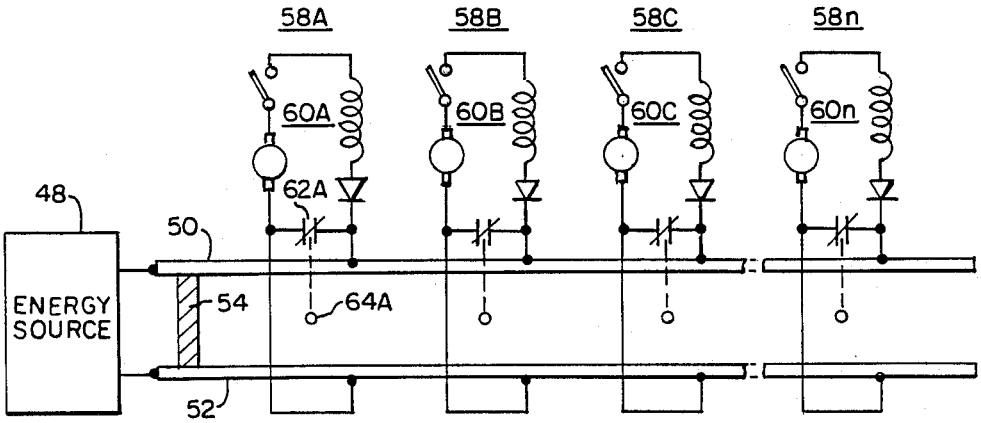
PRIOR ART FIG. 3.
FIG. 3 illustrates a prior art multi-stage system with distributed homopolar generator-inductor power supplies.

The apparatus depicted in FIG. 3 includes an energy source 48 similar to that described in FIG. 1, and connected at the breech end to rails 50 and 52 bridged by armature 54.

A plurality of energy storage stages 58A, 58B, 58C . . . **58*n* are connected to the rails for sequential injection of current during armature travel. Examining stage 58A as exemplary, an inductive energy storage arrangement 60A is provided of the type described in FIG. 1. Switch 62A is maintained in a closed position during buildup of current in the inductor portion of the storage arrangement and is opened by a signal from sensor 64A as armature 54** passes.

During operation switch 62A must openw while carrying, for example, hundreds of thousands of amperes of current upon a triggering signal from sensor 64A, an operation which, with presently existing switches cannot be accomplished with the nanosecond accuracy of the FIG. 2 arrangement. The accuracy of current injection by switch 62A will be measured in milliseconds as opposed to microseconds and with an armature velocity of, for example, 3 kilometers per second, an essentially uncontrollable delay of 2 milliseconds represents an armature travel of 6 meters between the time of passing the stage current injection location when switch 62A should open and when in fact it actually opens.

With the present invention inductive energy sources may be used in multiple stages with ultraprecise current injection with a self-switching arrangement thereby allowing the utilization of inductive staged enery injection even for extremely high velocity launchers.

Figure 4:
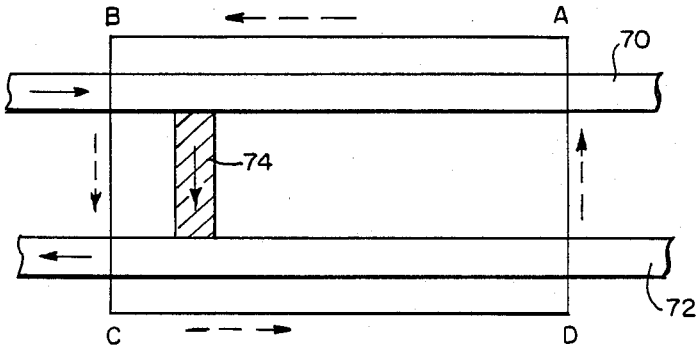
FIG. 4 illustrates a portion of electromagnetic launcher rails with an associated bore flux linking loop winding to explain a principle utilized in the present invention.

Before proceeding with the description of the embodiments of the present invention, reference is made to FIG. 4 to illustrate some basic principles utilized herein. FIG. 4 illustrates two rail segments, 70 and 72, with an armature 74 therebetween accelerating from left to right. A low resistance current conducting loop ABCD is placed adjacent the rails 70 and 72 to substantially link all the rail bore magnetic flux. Current flow through the rails and armature is depicted by the solid arrows. As flux due to this current enters the loop during armature travel, a loop voltage is generated, in accordance with the well-known Lenz's law to generate a current to oppose the buildup of flux, this induced current being indicated by the dotted arrows. With substantially total flux linkage, the induced voltage E in loop ABCD may be represented by the expression $$E = NIL'V \quad (1)$$

where

N is the number of turns of the loop (one in FIG. 4);

I is the rail current;

L' is the rail inductance per unit length;

V is the armature velocity.

Figure 5:
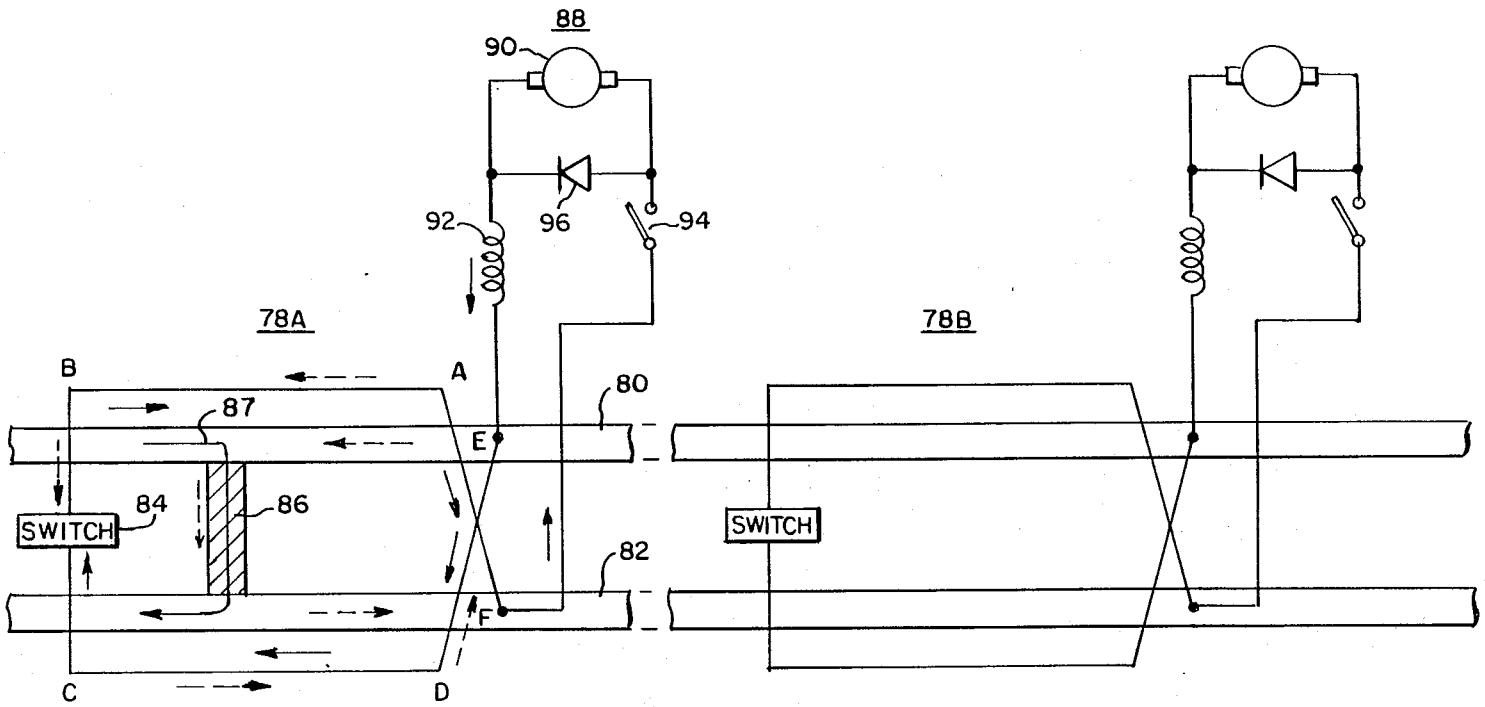
FIG. 5 illustrates an electromagnetic launch system in accordance with one embodiment of the present invention.

The principles illustrated in FIG. 4 are utilized in one embodiment of the present invention illustrated in FIG. 5 wherein two substantially identical energy storage stages 78A and 78B are shown at spaced-apart locations connected to rails 80 and 82. Examining stage 78A as exemplary, there is provided a conductor loop ABCD similar to the loop of FIG. 4, however, with points A and D being connected to the rails 82 and 80 at connection points F and E, respectively. Additionally, the loop includes a switch means 84, a preferred example of which would be an array of controlled rectifiers such as thyristors. As will be explained, the current inductively generated in the auxiliary loop ABCD as armature 86 traverses the loop, is utilized to produce a current zero condition in switch 84 to inject current from an inductive energy storage arrangement 88 into the rails at E and F as armature 86 passes. The current through armature 86 is represented by arrow 87 and is supplied by an energy supply or energy supplies on the breech side of energy supply 78A.

The inductive energy storage arrangement 88 is similar to that illustrated in FIG. 1 and includes a homopolar generator 90, inductor 92 and a make switch 94. The crowbar function is depicted as diode array 96.

Figure 6:
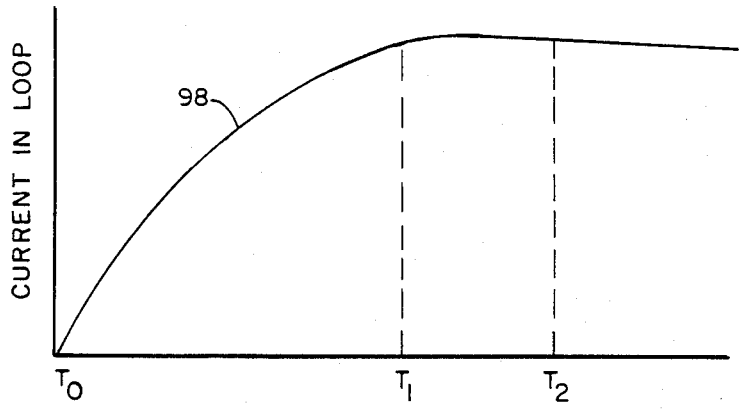
FIG. 6 is a curve illustrating current buildup in an auxiliary power supply.

With additional reference to FIG. 6, switch 94 is closed at time $T_0$ to commence the charging up of current in inductor 92, as represented by curve 98. While the armature 86 traverses the loop from B to A, inductor 92 will be delivering a current as indicated by the solid arrows and of a magnitude represented by the curve in the time window from time $T_1$ to $T_2$ and being of fairly constant magnitude as compared with the curve from $T_0$ to $T_1$. Since adjacent energy storage stages may be tens of meters away, a combination of rail inductance, as well as their own local storage inductances, will combine to form very high alternative impedance paths such that the current generated by stage 88 will substantially only flow through switch 84 in the low impedance loop EDCBAF.

Figure 7:
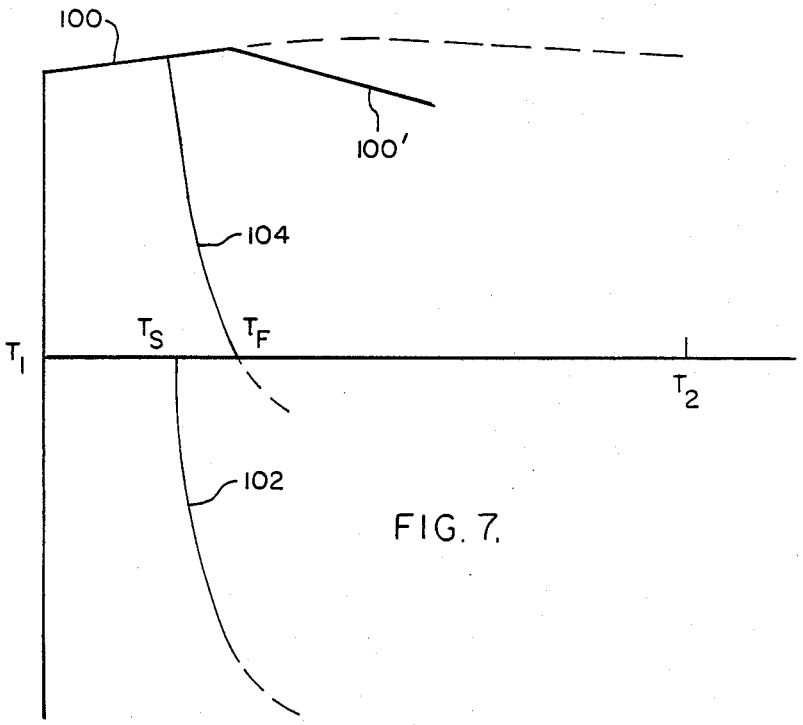
FIG. 7 serves to illustrate current relationships during operation of the present invention.

As soon as armature 86 enters the loop at BC, there will be developed in the loop a voltage of a magnitude up to NIL'V, according to Lenz's law, with the voltage being in a direction to tend to produce a countercurrent, as indicated by the dotted arrows in the direction ABCDE, through top rail 80, through armature 86, through bottom rail 82, F, and back to A. Although current does not actually flow through thyristor switch array 84 in a reverse direction, the countercurrent acts to diminish the magnitude of the net current supplied by inductor 92 and flowing through array 84. For example, with reference to FIG. 7, the solid-dotted curve 100 from time $T_1$ to $T_2$ represents on an expanded scale the same portion of the curve from $T_1$ to $T_2$, as was illustrated in FIG. 6. Curve 102 represents the buildup of the countercurrent due to the Lenz's law effect, and this current will be in a direction opposite to that of the inductor current. Current flow as indicated by curve 102 starts at $T_S$ when the armature passes BC. From an analysis standpoint, the countercurrent is subtracted from the inductor current through switch 84 with the net result being as indicated by curve 104. It is seen that the net current decreases in magnitude and at time $T_F$ the net current in the loop is zero, and the thyristor switch arraw 84 becomes non-conducting. Thereafter, the current supplied by inductor 92 will flow through the armature 86, thereby supplying makeup current to drive the armature and projectile. Accordingly, the current supplied to the inductor starts to drop at firing time $T_F$ and this is indicated by the solid curved portion 100'. This process is repeated at the next and any subsequent stages so that makeup current is periodically added during the course of travel of the armature.

By way of example, let it be assumed that the maximum desired initial rail current is 2,000,000 amperes (2 MA) and that makeup current is to be added to points along the rail length where the accelerating current has dropped by 25%, that is to 1.5 MA. Therefore, the average makeup current magnitude between $T_1$ and $T_2$ in FIGS. 6 and 7 should be around 500 kA. That is, as armature 86 arrives at the loop at time $T_S$, the current supplied by inductor 92 is around 500 kA flowing in the direction of the solid arrows. The armature should arrive at the loop in the relatively large time window $T_1$ to $T_2$ which can readily be tens of milliseconds, whereas the counterpulse current duration, $T_S$ to $T_F$ will at high armature velocities occur in hundreds of microseconds. For a single turn loop having a self inductance of about 0.4 $\mu$H, a countercurrent equal in magnitude to the inductor current, will be generated for a loop length, in the direction of the rails, in the order of 1 meter. Terminals EF are at a location so that current zero through switch 84 is attained when the armature 86 is close to EF.

Although in a preferred embodiment, switch 84 is a large array of solid-state controlled rectifiers, other alternatives are possible. For example, a much smaller array of controlled rectifiers may be used if they are paralleled by massive metallic contacts which short out the array until just before $T_1$ and which are then open circuited such that the small array conducts the current starting only at $T_1$ and therefore for a much shorter duration then if the array had to conduct during the build up to firing current magnitude.

It is to be noted that with the loop arrangement, current supplied by inductor 92 is in the same direction as the rail current 87 in segments DC and BA and therefore augments the flux and thereby increases the accelerating force on the armature 86. As the countercurrent magnitude builds up, the augmentation is reduced, however the net driving current through armature 86 increases as the countercurrent component is additive to the driving current 87 emanating from a previous stage or stages.

Figure 8:
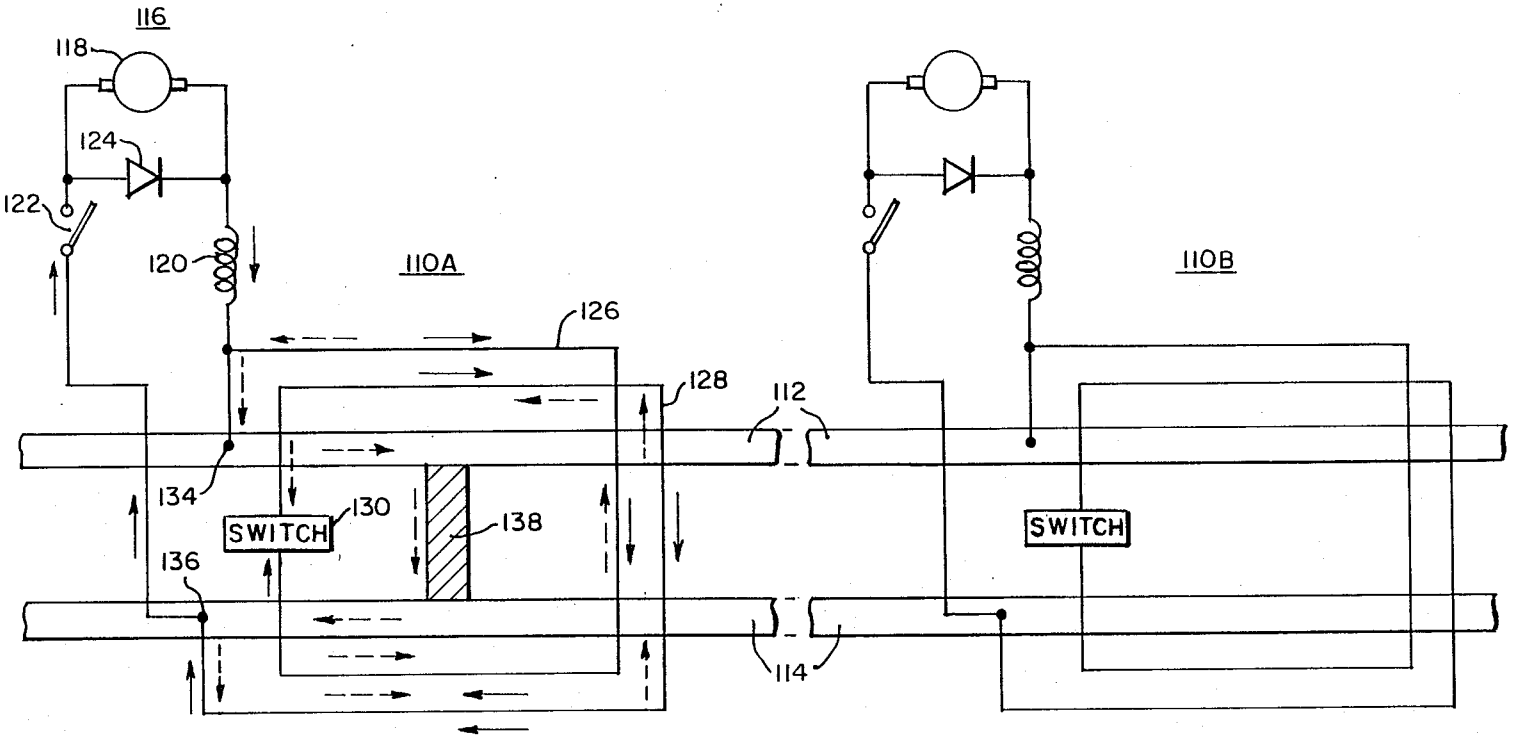
FIG. 8 illustrates another embodiment of the present invention.

In FIG. 5 there is illustrated an arrangement wherein a single loop is folded back toward the breech end of the rails. In FIG. 8 there is illustrated another embodiment of the present invention wherein a plurality of loops are utilized with each loop being folded toward the muzzle end of the rails.

Two stages, 110A and 110B, are illustrated as being connected to rails 112 and 114 at spaced apart locations. Examining stage 110A, each stage includes an inductive energy storage supply 116 which includes a homopolar generator 118, an inductor 120 and a make switch 122. As in the FIG. 5 arrangement, a diode array 124 connected across the homopolar generator represents a crowbar function.

By way of example, two loops, 126 and 128, are illustrated and are connected in series with a switch array 130, similar to switch 84 in FIG. 5. The inductive energy supply as well as the loops are electrically connected to the rails 112 and 114 at respective connection points 134 and 136. As previously explained, when the make switch 122 is closed inductor charging current flows in the circuit, as indicated by the solid arrows. Once the armature 138 enters the loop area to the right of connection points 134, 136, a countervoltage is produced to generate a current, the flow of which is indicated by the dotted arrows.

Whereas in FIG. 5, a premature current zero causes a momentary reverse acceleration force component to be exerted on armature 86 by injecting current into the rails prior to armature arrival at EF, the makeup current in FIG. 8 cannot cause any such reverse acceleration force since it flows in the rails and armature in the same direction as the current remaining from previous stages. That is, in FIG. 8 the countercurrent necessary for current zero cannot be generated until armature 38 has passed the makeup current injection points at connections 134 and 136. As was the case with respect to FIG. 5, charging current, illustrated by the solid arrows, augments the rail bore flux while the countercurrent through the armature 138 is in the same direction as the rail current therethrough.

Figure 9A:
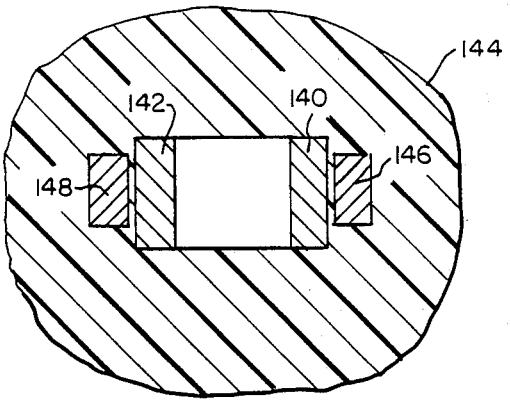
FIGS. 9A through 9C illustrate typical rail and loop arrangements.
Figure 9B:
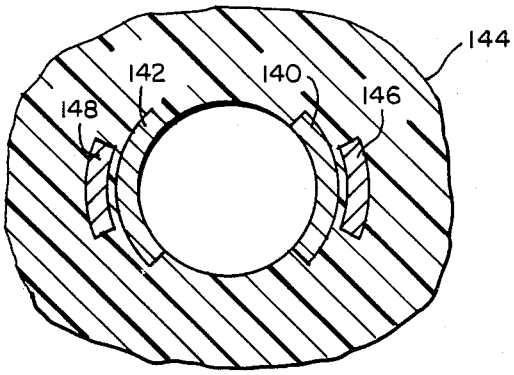
Figure 9C:
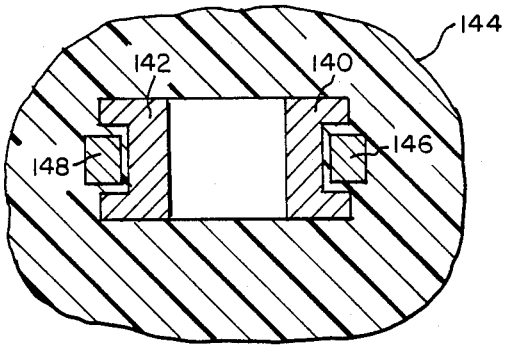

The countercurrent loops described herein are physically located adjacent the rails so as to substantially link all of the flux between the rails, for the length of the loop. FIGS. 9A through 9C show three different cross-sectional embodiments of possible arrangements. In FIG. 9A, rails 140 and 142 are disposed in an insulating support structure 144 and which includes loop windings 146 and 148, representing for example cross-sectional views of loop segments AB and DC, respectively, of FIG. 5. The components of FIGS. 9B and 9C have been given the same reference numerals as those in FIG. 9A and represent, respectively, a round bore arrangement (FIG. 9B) and an arrangement wherein the loop winding segments are almost coaxial with the rails (FIG. 9C). The exact positioning of auxiliary windings relative to the rails is a matter of design choice, and such arrangements as illustrated in FIGS. 9A through 9C are well known to those skilled in the art, the arrangements being utilized for augmenting windings.

I claim:

1. An electromagnetic projectile launcher comprising:

(A) a pair of generally parallel conductive rails having a breech end and a muzzle end;

(B) means for conducting current between said rails and for propelling a projectile along said rails;

(C) means for supplying a high current to said rails to launch said means for conducting;

(D) at least one energy storage stage connected to said rails downstream of said breech end and including:

(i) an inductive power supply, (ii) switch means connected to conduct current supplied by said inductive power supply, and (iii) means for generating a current zero in said switch means when said means for conducting is in the vicinity of said connection;

(E) said means for generating a current zero including:

(i) at least one electrically conducting loop connected to conduct current from said inductive power supply, said switch means being serially connected in said loop;

(F) said loop being adjacent to and in flux linking relationship with said rails;

(G) said loop being electrically connected to said inductive power supply such that as said means for conducting and propelling passes through said loop, a current is generated in said loop which is in opposition to said inductive power supply current there-through whereby current supplied by said inductive power supply is directed into said rails.

2. Apparatus according to claim 3 which includes:

(A) a plurality of said energy storage stages connected to said rails at spaced-apart locations.

3. Apparatus according to claim 1 which includes:

(A) a plurality of said energy storage stages connected to said rails at spaced-apart locations.

4. Apparatus according to claim 1 wherein:

(A) said loop is comprised of a plurality of windings.

5. Apparatus according to claim 1 wherein:

(A) said loop extends a predetermined distance from said connection toward said breech end.

6. Apparatus according to claim 1 wherein:

(A) said loop extends a predetermined distance from said connection toward said muzzle end whereby said current supplied by said inductive power supply is directed into said rails after said means for conducting and propelling has passed said connection.

7. Apparatus according to claim 1 wherein:

(A) said switch means is an array of controlled rectifier devices.

8. Apparatus according to claim 7 wherein:

(A) said controlled rectifier devices are solid-state devices.

9. Apparatus according to claim 1 wherein:

(A) said loop includes one segment adjacent one rail of said pair and another segment adjacent the other rail of said pair;

(B) said loop being oriented such that when it is conducting current from said inductive power supply, the current direction in said one segment is the same as rail current in said one rail and current direction in said another segment is the same as rail current in said other rail of said pair.

10. A method of operating an electromagnetic parallel rail projectile launcher having means for conducting current between said rails to propel a projectile and having at least one inductive energy stage connected to the rails downstream of the breech end thereof comprising the steps of:

(A) connecting to said rails at said inductive energy stage connection, a bore flux linking winding having a series connected switching means;

(B) initially conducting inductive energy stage current through said bore flux linking winding and switching means;

(C) creating a current zero in said switching means by a counterpulse current induced by motion of the means for conducting between said rails as it passes through said bore flux linking winding, whereby said inductive energy stage current is interrupted in said bore flux linking winding and switching means and is switched into said rails.

11. A method according to claim 10 wherein current supplied by said inductive energy stage includes a relatively constant portion of a magnitude substantially equivalent to that desired to be supplied as makeup current, comprising the step of:

(A) timing said current zero to occur during said relatively constant portion of said inductive energy stage current.

12. A method according to claim 10 which comprises the steps of:

(A) connecting a plurality of said inductive energy stages and said bore flux linking windings to said rails at respective spaced apart locations whereby the projectile propelling current remains at a desired magnitude throughout projectile traverse.

* * * * *